US007472574B2

(12) United States Patent
Pawelski et al.

(10) Patent No.: US 7,472,574 B2
(45) Date of Patent: Jan. 6, 2009

(54) METHOD OF AND ROLLING MILL STAND FOR COLD ROLLING MILL STAND FOR COLD ROLLING OF METALLIC ROLLING STOCK IN PARTICULAR ROLLING STRIP WITH NOZZLES FOR GASEOUS OR LIQUID TREATMENT MEDIA

(76) Inventors: Hartmut Pawelski, Am Wachtelweg 6, Ratingen (DE) D-40883; Hans-Peter Richter, In der Kalkbitze 6, Friedewald (DE) D-57520; Ludwig Weingarten, Rethelstrasse 167, Duesseldorf (DE) D-40237; Peter Jollet, Parkstrasse 39, Duesseldorf (DE) D-40477

( * ) Notice: Subject to any disclaimer, the term of this patent is extended or adjusted under 35 U.S.C. 154(b) by 54 days.

(21) Appl. No.: 11/629,220

(22) PCT Filed: May 23, 2005

(86) PCT No.: PCT/EP2005/005566

§ 371 (c)(1),
(2), (4) Date: Dec. 7, 2006

(87) PCT Pub. No.: WO2005/120739

PCT Pub. Date: Dec. 22, 2005

(65) Prior Publication Data

US 2007/0175255 A1 Aug. 2, 2007

(30) Foreign Application Priority Data

Jun. 9, 2004 (DE) ..... 10 2004 028 006
Aug. 20, 2004 (DE) ..... 10 2004 040 375

(51) Int. Cl.
*B21B 27/06* (2006.01)

(52) U.S. Cl. ..... 72/201; 72/38; 72/43; 72/201; 72/236

(58) Field of Classification Search ..... 72/38, 72/39, 41, 43, 200–202, 236, 365.2, 342.2
See application file for complete search history.

(56) References Cited

U.S. PATENT DOCUMENTS

| | | | | |
|---|---|---|---|---|
| 6,497,127 | B2 * | 12/2002 | Nishiura et al. | 72/44 |
| 6,675,622 | B2 * | 1/2004 | Plicht et al. | 72/201 |
| 6,834,521 | B1 * | 12/2004 | Denker et al. | 72/39 |
| 6,874,344 | B1 | 4/2005 | Junius et al. | |
| 7,159,433 | B2 * | 1/2007 | Seidel | 72/201 |
| 2004/0217184 | A1 * | 11/2004 | Seidel | |

FOREIGN PATENT DOCUMENTS

| | | | |
|---|---|---|---|
| EP | 0794023 | | 9/1997 |
| JP | 6-31315 | * | 2/1994 |
| WO | 2087803 | | 7/2002 |

OTHER PUBLICATIONS

Patent Abstract of Japan, JP 2000280002, Oct. 2000.
* cited by examiner

*Primary Examiner*—Edward Tolan
(74) *Attorney, Agent, or Firm*—Abelman, Frayne & Schwab

(57) ABSTRACT

A method of and a rolling mill stand for cold rolling of a metallic rolling stock (1), in particular rolling strip (1*b*) with nozzles for gaseous or liquid treatment media, with which the rolling stock (1) is displaced under a processing temperature through a roll gap (40) of a roll pair of upper working roll (2) and lower working roll (3) to undergo plastic deformation, and which permits in addition to a rolling stock surface improvement, the lubrication and surface protection of the rolling stock (1) and the rollers (2, 3) by a reduction in roll separating, with introduction of deep-chilled media, whereby deep chilled inert gas (41), ambient temperature inert gas (41*a*), lubricant emulsion (42), of admixed base oil, or oil-free, non-residue evaporating hydrocarbons are introduced against the sides (2*a*; 3*a*) of the working rollers (2, 3), and/or the rolling gap (40), and/or the rolling stock (1) in groups of jets from individual rows of nozzles (6*a* to 22*b*) for lubrication, cooling, and for inerting.

4 Claims, 3 Drawing Sheets

FIG. 3

Figure 1:
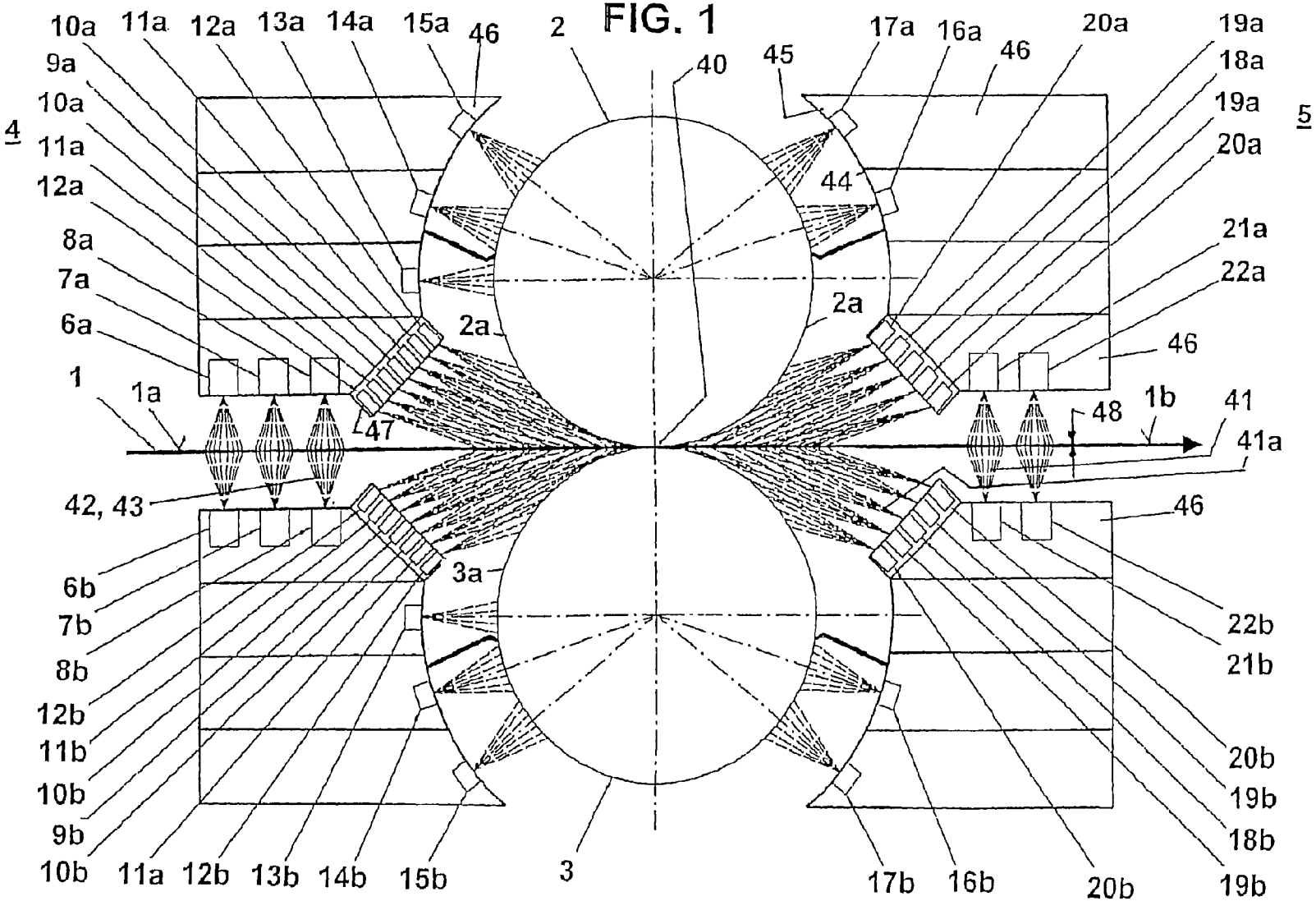

| | Strip Entry Side 6, 7, 8 | Roll Gap Entry Side 9 - 12 | Rolls Entry Side 13, 14, 15 | Rolls Exit Side 16, 17 | Wedge Rolls-Strip Exit Side 18, 19, 20 | Strip Exit Side 21, 22 |
|---|---|---|---|---|---|---|
| Lubrication* | X | X | X | | | |
| Cooling | X | X | X | X | X | X |
| Inerting | | X | | | (X) | |
| Cleaning | X | X | X | X | X | X |

* Minimal lubrication or conventional cold lubrication with emulsion

METHOD OF AND ROLLING MILL STAND FOR COLD ROLLING MILL STAND FOR COLD ROLLING OF METALLIC ROLLING STOCK IN PARTICULAR ROLLING STRIP WITH NOZZLES FOR GASEOUS OR LIQUID TREATMENT MEDIA

This application is a 35 USC 371 of PCT/EP05/05566 filed May 23, 2005.

The present invention relates to a method of and a rolling mill stand for cold rolling of a metallic rolling stock, in particular rolling strip with nozzles for gaseous or liquid treatment media, with which the rolling stock is displaced under a processing temperature through a roll gap of a roll pair of upper working roll and lower working roll to undergo plastic deformation.

EP 12 30 045 B1/DE 199 53 230 C2 discloses a method of cold rolling of a metallic rolling stock in which the rolling stock is displaced through a roll gap between rolls driven in opposite directions under a room temperature to undergo a plastic deformation.

In order to reduce the friction heat, an inert gas, which has a lower temperature than the rolling stock temperature, is blown into the roll gap. The inert gas ($N_2$) is blown into in a deep-chilled state and below its liquefying temperature. The advantage of this method consists in the improvement of strip surface quality. However, the initially intended lubrication action, which extensive studies based on a mathematical process model suggested, unexpectedly, did not take place. Ultimately, the introduction of a deep-chilled inert gas permitted to simply achieve cooling of the rolling stock and/or the rolls in the roll gap, while wear of the rolls and the kinematics of the rolling process remain unconsidered.

The object of the invention is to provide, upon feeding of deep-chilled media, in addition to the improvement of the rolling stock surface, also for lubrication and for protection of the surface of the rolling stock and the rolls by reduction of the roll separating force.

According to the invention, this object is achieved, in addition to measures indicated at the beginning, by feeding jet groups from respective separate nozzle rows of deep-chilled inert gas, of inert gas at a normal temperature, of lubricant emulsion, of admixed base oil, or of oil-free, residue-free, evaporated hydrocarbons against the flanks of the working rolls and/or the roll gap and/or the rolling stock for lubrication cooling, cleaning, and inerting. Thereby, not only the rolling stock surface is improved, but simultaneously the necessary lubrication for the rolling process and for the normal wear of the rolls is insured, while simultaneously measures for retaining of the rolled surface and the roll surface are undertaken. Thus, in addition to a water-oil mixture, e.g., liquid nitrogen can be used.

According to one embodiment, it is proposed that the nozzle rows feed the media jets of lubricant emulsion or base oil closely adjacent to the nozzle rows of a deep-chilled inert gas. With this, the temperatures of a respective lubricant and those of the inert gas are adapted to each other.

A further embodiment contemplates that a minimal amount of the lubricant emulsion, base oil, or oil-free, residue-free evaporated hydrocarbons is introduced, as so-called additive application, in form of a layer having a certain thickness in accordance with surface roughness of the rolling stock. Such lubrication with a minimal amount can take place with the lubricant jets being surrounded by inert gas having a matching temperature. The frictional resistance in the roll gap can be changed, dependent on the product and the pass reduction program, by varying the amount of the applied lubricant.

A minimal amount of the lubricant can be used by varying the type of the lubricant with comparatively low expenses.

An adaptation of different sections of the rolling region can be carried out, according to the other features so that lubrication, cooling, inerting, and cleaning can be adapted, respectively, for the rolling stock inlet side, roll gap inlet, roll entry, roll exit, wedge-shaped roll-rolling stock exit, and the rolling stock exit side.

In addition, an effective measure consists in that a minimal amount of the lubricant is applied on the rolling stock surface at the rolling stock entry, and at the entry side, the inert gas is introduced in the roll gap. The temperature of the inert medium can be selected so that it corresponds to the selected lubricant. At the exit side, a cold medium such as, e.g., liquid nitrogen or any other cold inert gas should be introduced in the roll gap.

According to a further advantageous embodiment, a minimal amount of lubricant of lubricant emulsion, or base oil, or oil-free, residue-free evaporated hydrocarbons, which is introduced into the roll gap at the entry side, is introduced surrounded by an inert gas. As inertia medium in this case, gaseous nitrogen is used at a temperature commensurable with the lubricant.

Cooling, cleaning and inerting can be effected by introducing a deep-chilled inert gas in the section of the wedge-shaped roll-rolling stock exit.

A particular alternative consists in the use of the above-described method in at least one of the last rolling stands of a tandem rolling mill train with a pass reduction of the rolling stock of less than 10%. Because such end rolling mill stands in tandem rolling mill trains, which are widely popular, are operated only with a small pass reduction, a reduction of the rolling stock tension, e.g., of the strip tension at a rolling-up reel is possible, and a homogeneous surface embossing of the working rolls and insurance of the strip dryness on the basis of the described invention is achieved at a further improved level.

A separate emulsion apparatus with a lean emulsion for the last rolling mill stand, which is conventional in the tandem rolling mill trains, can be completely eliminated. The service life of the working rolls is increased, and a desired roughness is retained for a longer period of time. The surface quality, a definite homogeneously distributed roughness over the strip width of the exiting strip is improved. The existed problems associated with emulsion residues on the strip, and a strip-blow off region behind the last rolling mill stand of a rolling mill train are eliminated.

In this rolling mill train, advantageously, the rolling stock is cooled behind the last but one rolling mill stand with cooling means and the lubricant emulsion, or with base oil, or with oil-free, residue-free, evaporated hydrocarbons.

Further features relate to preparation for further handling of the rolling strip, wherein after cooling of the rolling strip, the cooling means and the lubricant emulsion or the base oil is removed by being squeezed off or blown-off.

The protection of the finally rolled rolling stock or rolling strip consists in that a minimal amount of the lubricant emulsion, or the base oil, or the oil-free, residue-free, evaporated hydrocarbons is applied, if needed, to the rolling stock or the working rolls again after the squeezing-off and/or blow-off. Thereby, the mean frictional resistance in the roll gap is reduced to such an extent that the predetermined pass reduction is achieved with a not too high separation force, and no slippage because of a too strong strip pull.

Advantageously, in addition, the cooling means in form of a deep-chilled inert gas is introduced in the roll gap before the last rolling mill stand.

According to a further development of the invention, alternatively, the lubricant emulsion, or the base oil, or the oil-free, residue-free, evaporated hydrocarbons are introduced in the roll gap before the last rolling mill stand in pulverized form within or surrounded by a curtain of the deep-chilled inert gas.

The foregoing development is effected by treating the rolling stock and the working rolls by introducing the deep-chilled inert gas in a wedge between the working rolls and the rolling stock by applying to the working rolls and/or the rolling stock.

Further, the method of cold rolling of a metallic rolling stock and, in particular of a rolling strip, according to which the rolling stock is displaced under a processing temperature through a roll gap of a working roll pair to undergo a plastic deformation, and jet groups from respective separate nozzle rows of deep-chilled inert gas, of inert gas at a normal temperature, of lubricant emulsion, or of admixed base oil, or of oil-free, residue-free, evaporated hydrocarbons are fed against the flanks of the working rolls and/or the roll gap and/or the rolling stock for lubrication cooling, cleaning and inerting, is used for controlling flatness of a thermal working roll barrel for reducing and/or controlling control values.

An improvement is further achieved by overriding the flatness control additionally by application of chilled lubricant emulsion, or base oil, or oil-free, residue-free evaporated hydrocarbons.

The producible flatness error then would not be so serious as before.

The invention, which is described below, relates to a rolling mill stand for cold rolling of a metallic rolling stock, in particular, of a rolling strip, with associated with the working rolls, nozzles for solid, gaseous, and/or liquid treatment media.

The object of the invention is achieved, according to the invention, with such a rolling mill stand in which associated with an upper working roll and an inner working roll, arranged one above another, nozzle segments provided, respectively, on a side circumference, are located opposite the working rolls, with directed toward the working rolls and/or the rolling stock nozzle rows for the treatment media for cleaning, cooling, lubrication, and/or inerting. Thereby, the service life of the working rolls and the required roughness are retained for a longer period of time. The surface quality of the exiting strip (a predetermined homogeneously distributed roughness over the strip width) is improved. Problems with emulsion residues on the rolling strip and behind the blow-off region are eliminated (behind the last rolling mill stand). The frictional resistance in the roll gap can be adapted, dependent on the product and on the pass table, by varying the amount of the applied lubricant. The use of different types of lubricants, with a minimal amount of lubricant advantageously can take place with comparatively low expenses. According to one embodiment, nozzle rows, which are directed radially against the upper working roll and against the lower working roll, are provided on an entry side.

Analogous thereto, nozzle rows, which are directed radially against the upper working roll and the lower working roll, are arranged mirror-symmetrically on an exit side.

These nozzle rows are thus directed in a direction opposite the running direction of the rolling stock and produce, in the roll gap wedge, combination, space-filling mixtures of lubricant jets and gas jets of different temperatures for thereafter, cooling of the roll surface or the rolling stock, for lubricating, or for protection against oxidation.

For forming such space-filling jet groups, advantageously, nozzle blocks which are directed, respectively, toward the roll gap and simultaneously toward adjoining flanks of the upper and lower working rolls and which extend at an angle of less than 45° against the rolling stock surface, contain arranged next to each other nozzle rows.

For preparation of cooling or protective gases having different temperatures, liquids, lubricant emulsions, or base oil, there is proposed an arrangement according to which nozzle segments, which are arranged, respectively, immediately adjacent to the rolling stock are provided with nozzle rows which are directed perpendicular from below and from above against the rolling stock surface on the entry side and are provided with nozzle rows on the exit side.

The drawings show embodiments on the basis of which the method will be explained below and will be further clarified with reference to the installation.

Figure 2:
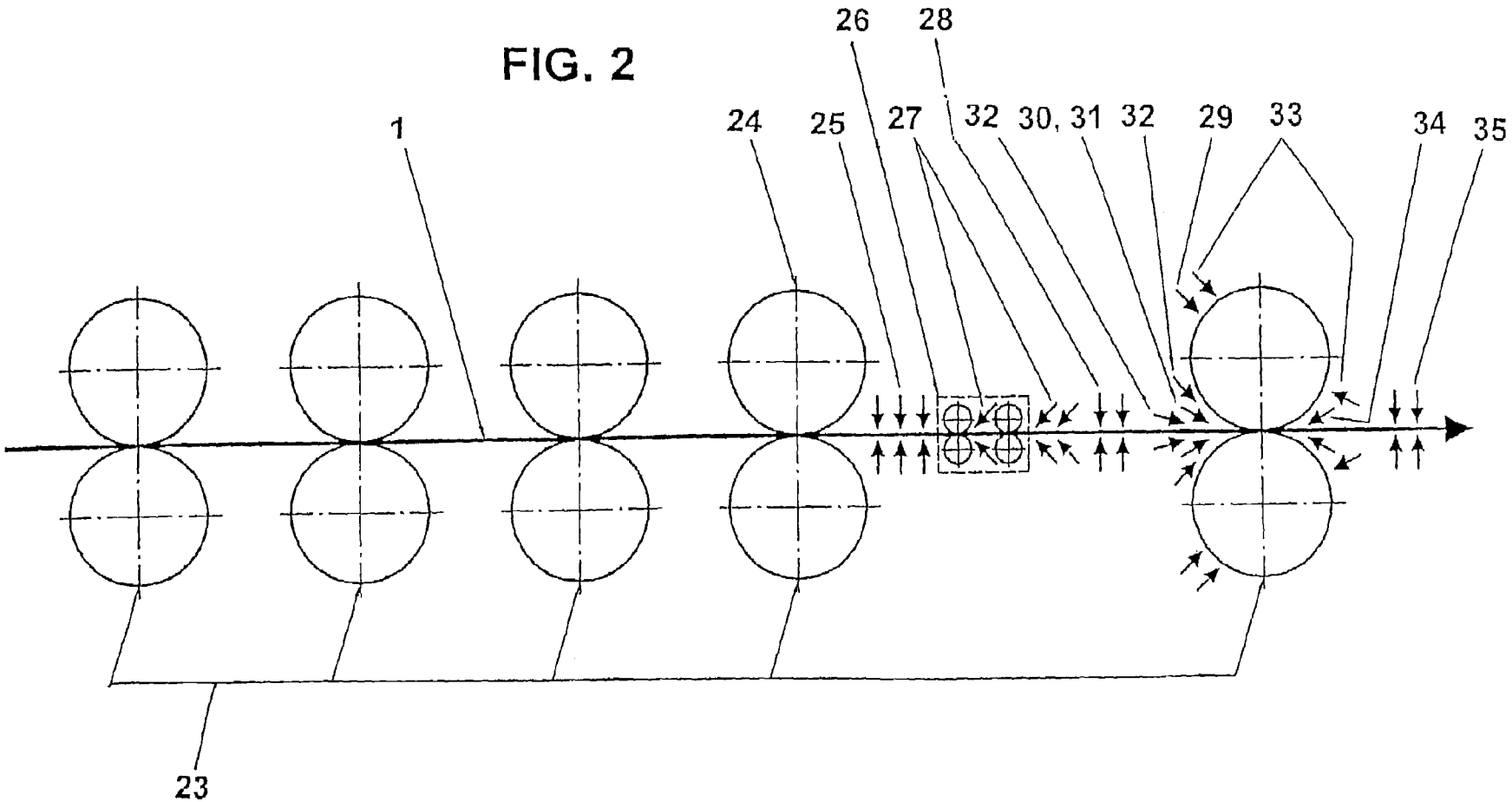

The drawings show:

FIG. 1 a side view of a pair of working rolls with nozzle segments;

FIG. 2 a side view of a tandem rolling mill train that incorporates the invention and represents an example of its application; and FIG. 3 a matrix representation illustrating an example of distribution of cooling, lubricating, cleaning, and inerting media.

According to FIG. 1, rolling stock 1 in form of a rolling strip 1*b* is displaced under a processing temperature (generally the normal temperature) through a roll gap 40 formed between an upper working roll 2 and a lower working roll 3 in a direction from an entry side 4 to an exit side 5 to undergo a plastic deformation and, thereby, is rolled. For lubrication (reduction of the rolling forces), cooling (removal of heat generated by the rolling process) and cleaning (from residues and/or oxidation) of a rolling stock surface 1*a*, media jet groups from respective separate, associated with each other nozzle rows are directed against flanks 2*a*, 3*a* of the working rolls 2, 3 and/or the rolling stock 1 as follows:

- Nozzle row 6*a*, from above (rolling stock 1, entry side 4: cleaning)
- Nozzle row 6*b*, from below (rolling stock 1, entry side 4: cleaning)
- Nozzle row 7*a*, from above (rolling stock 1, entry side 4: cooling)
- Nozzle row 7*b*, from below (rolling stock 1, entry side 4: cooling)
- Nozzle row 8*a*, from above (rolling stock 1, entry side 4: lubrication)
- Nozzle row 8*b*, from below (rolling stock 1, entry side 4: lubrication)
- Nozzle row 9*a*, from above (roll gap 40, entry side 4: lubrication)
- Nozzle row 9*b*, from below (roll gap 40, entry side 4: lubrication)
- Nozzle row 10*a*, from above (roll gap 40, entry side 4: cooling)
- Nozzle row 10*b*, from below (roll gap 40, entry side 4: cooling)
- Nozzle row 11*a*, from above (roll gap 40, entry side 4: cleaning)
- Nozzle row 11*b*, from below (roll gap 40, entry side 4: cleaning)
- Nozzle row 12*a*, from above (roll gap 40, entry side 4: inerting)
- Nozzle row 12*b*, from below (roll gap 40, entry side 4: inerting)
- Nozzle row 13*a*, from above (working roll 2, entry side 4: lubrication)

Nozzle row 13*b*, from below (working roll 3, entry side 4: lubrication)

Nozzle row 14*a*, from above (working roll 2, entry side 4: cooling)

Nozzle row 14*b*, from below (working roll 3, entry side 4: cooling)

Nozzle row 15*a*, from above (working roll 2, entry side 4: cleaning)

Nozzle row 15*b*, from below (working roll 3, entry side 4: cleaning Nozzle row 16*a*, from above (working roll 2, exit side 5: cooling)

Nozzle row 16*b*, from below (working roll 3, exit side 5: cooling)

Nozzle row 17*a*, from above (working roll 2, exit side 5: cleaning)

Nozzle row 17*b*, from below (working roll 3, exit side 5: cleaning)

Nozzle row 18*a*, from above (roll gap 40, exit side: inerting)

Nozzle row 18*b*, from below (roll gap 40, exit side: inerting)

Nozzle row 19*a*, from above (roll gap 40, exit side 5: cooling)

Nozzle row 19*b*, from below (roll gap 40 exit side 5: cooling)

Nozzle row 20*a*, from above (roll gap 40, exit side 5: cleaning)

Nozzle row 20*b*, from below (roll gap 40, exit side 5: cleaning)

Nozzle row 21*a*, from above (rolling stock 1, exit side 5: cooling)

Nozzle row 21*b*, from below (rolling stock 1, exit side 5: cooling)

Nozzle row 22*a*, from above (rolling stock 1, exit side 5: cleaning)

Nozzle row 22*b*, from below (rolling stock 1, exit side 5: cleaning).

As further can be seen in FIG. 1, the nozzle rows 8*a*, 8*b*; 9*a*, 9*b*; 13*a*, 13*b* feed the media jets of lubricant emulsion 42 or base oil 43 closely adjacent to the nozzle rows 7*a*, 7*b*; 10*a*, 10*b*; 14*a*, 14*b*; 16*a*, 16*b*; 19*a*, 19*b*; 21*a*, 21*b* of a deep-chilled inert gas.

A minimal amount of the lubricant emulsion 42 can be introduced, as so-called additive application, in form of a layer 48 having a certain thickness in accordance with surface roughness of the rolling stock surface 1*a* of the rolling stock 1 or the rolling strip 16.

Different circumferential curve sections of the working rolls 2, 3 are divided in sections 44. Based on this division, for these sections 44, the lubrication, cooling, inerting, and cleaning can be adapted, respectively, for the rolling stock inlet side 4, roll gap inlet, roll entry roll exit, wedge-shaped roll-rolling stock exit, and the rolling stock exit side.

At that, one proceeds from applying a minimal amount of lubricant on the rolling stock surface 1*a* at the rolling stock entry, and at the entry side, an inert gas, e.g., deep-chilled nitrogent, is introduced in the roll gap 40 at the inlet side.

The tight arrangement of nozzles in the nozzle blocks 47 provides for introduction, into the roll gap 40 at the entry side, of applied minimal amount of lubricant of lubricant emulsion 42, or base oil 43, or oil-free, residue-free, evaporated hydrocarbons which are surrounded by a deep-chilled inert gas 41.

Likewise, the deep-chilled inert gas 41 is introduced in the section 44 of the wedge-shaped roll-rolling stock exit.

In FIG. 2, the process of cold rolling of the metallic rolling stock 1 which was described at the beginning and according to which the rolling stock 1 is displaced under a processing temperature through a roll gap 40 of a working roll pair 2, 3 of the upper and lower working rolls 2, 3 to undergo a plastic deformation, and jet groups from respective separate nozzle rows 6*a* . . . 22*b* of deep-chilled inert gas 41, of inert gas 41*a* at a normal temperature of lubricant emulsion 42, or of admixed bas oil 43, or of oil-free, residue-free, evaporated hydrocarbons are applied against the flanks 2*a*, 31 of the working rolls 2, 3, and/or the roll gap 40, and/or the rolling stock 1 for lubrication, cooling, cleaning, and inerting, is used in at least one of the last rolling mill stands of a tandem rolling mill train 23 with a pass reduction of the rolling stock less than 10%. Thereby, the rolling stock 1 can be produced in tandem rolling mill trains with a particular clean and smooth rolling stock surface 1*a*.

Behind the last but one rolling mill stand 24, the rolling stock 1 is cooled with cooling means and lubricant emulsion 42, or the base oil 43, or oil-free, residue-free, evaporated hydrocarbons. After the cooling of the rolling stock 1, the cooling means and the lubricant emulsion 42, or the base oil 43 are removed by squeezing in a squeeze unit 26 and/or by blowing-off.

At that, the rolling stock 1 behind the last but one rolling mill stand can be cooled with cooling means and lubricant emulsion 42, or the base oil 43, or oil-free, residue-free, evaporated hydrocarbons.

In the tandem rolling mill train 23 (or at an end of each other rolling mill train) behind an exit side, strip cooling means 25, i.e., after the cooling of the rolling stock 1, the cooling means and the lubricant emulsion 42, or the base oil 43 is removed by squeezing in a squeeze unit 26 and/or by blowing-off in a blow-off device 27.

For protection of the finally rolled rolling stock 1, the lubricant emulsion 42, or the base oil 43, or the oil-free, residue-free, evaporated hydrocarbons are stored in a device 28 for applying a minimal amount of the lubricant behind the squeeze unit 26 for squeezing out and/or the device 27 for blowing-off to the rolling stock 1 or the working rolls 2, 3.

In addition, in the tandem rolling mill train 23, after the device 28, there are provided a device 32 for applying an inerting medium and a device 30 for applying the inerting medium, a device 31 for applying lubricant, and a device 32 aligned in the direction of the roll gap 40 for applying the inerting medium.

A device 29 for applying a minimal amount of lubricant is associated with the last roll pair 2, 3 of the tandem rolling mill train 23. At the entry side 4, there is located a device 33 for cooling/cleaning by applying a deep-chilled medium, and at the exit side 5, a device 34 for cooling/cleaning by application of the deep-chilled medium. At the end, the rolling stock 1 is subjected, with a device 35, to cooling/cleaning by application of the deep-chilled medium.

FIG. 3 shows an advantageous matrix for use and the arrangement of medium jets for lubrication, cooling, cleaning, and inerting. A plurality of such different matrices can be used.

REFERENCE NUMERALS

| | |
|---|---|
| 1 | Rolling stock |
| 1a | Rolling stock surface |
| 1b | Rolling strip |
| 2 | Upper working roll |
| 3 | Lower working roll |
| 3a | Flanks |
| 4 | Entry side |

-continued

| REFERENCE NUMERALS | |
|---|---|
| 5 | Exit side |
| 6a | Nozzle row (rolling stock, entry side: cleaning) |
| 6b | Nozzle row (rolling stock, entry side: cleaning) |
| 7a | Nozzle row (rolling stock, entry side: cooling) |
| 7b | Nozzle row (rolling stock, entry side: cooling) |
| 8a | Nozzle row (rolling stock, entry side: lubrication) |
| 8b | Nozzle row (rolling stock, entry side: lubrication) |
| 9a | Nozzle row (rolling stock, entry side: lubrication) |
| 9b | Nozzle row (rolling stock, entry side: lubrication) |
| 10a | Nozzle row (roll gap, entry side: cooling) |
| 10b | Nozzle row (roll gap, entry side: cooling) |
| 11a | Nozzle row (roll gap, entry side: cleaning) |
| 11b | Nozzle row (roll gap, entry side: cleaning) |
| 12a | Nozzle row (roll gap, entry side: inerting) |
| 12b | Nozzle row (roll gap, entry side: inerting) |
| 13a | Nozzle row (working roll, entry side: lubrication) |
| 13b | Nozzle row (working roll, entry side: lubrication) |
| 14a | Nozzle row (working roll, entry side: cooling) |
| 14b | Nozzle row (working roll, entry side: cooling) |
| 15a | Nozzle row (working roll, entry side: cleaning) |
| 15b | Nozzle row (working roll, entry side: cleaning) |
| 16a | Nozzle row (working roll, exit side: cooling) |
| 16b | Nozzle row (working roll, exit side: cooling) |
| 17a | Nozzle row (working roll, exit side: cleaning) |
| 17b | Nozzle row (working roll, exit side: cleaning) |
| 18a | Nozzle row (roll gap, exit side: inerting) |
| 18b | Nozzle row (roll gap, exit side: inerting) |
| 19a | Nozzle row (roll gap, exit side: cooling) |
| 19b | Nozzle row (roll gap, exit side: cooling) |
| 20a | Nozzle row (roll gap, exit side: cleaning) |
| 20b | Nozzle row (roll gap, exit side: cleaning) |
| 21a | Nozzle row (rolling stock, exit side: cooling) |
| 21b | Nozzle row (rolling stock, exit side: cooling) |
| 22a | Nozzle row (rolling stock, exit side: cleaning) |
| 22b | Nozzle row (rolling stock, exit side: cleaning) |
| 23 | Tandem rolling mill train |
| 24 | Last but one rolling mill stand |
| 25 | Exit side strip cooling means |
| 26 | Squeeze unit |
| 27 | Blow-off device |
| 28 | Device for applying a minimal amount of lubricant |
| 29 | Device for applying a minimal amount of lubricant |
| 30 | Device for applying inerting minimum |
| 31 | Device for applying lubricant |
| 32 | Device for applying an inerting medium |
| 33 | Device for cooling/cleaning by applying a deep-chilled medium |
| 34 | Device for cooling/cleaning by applying a deep-chilled medium |
| 35 | Device for cooling/cleaning by applying a deep-chilled medium |
| 40 | Roll gap |
| 41 | Deep-chilled inert gas |
| 41a | Inert gas with a normal temperature |
| 42 | Lubricant emulsion |
| 43 | Base oil |

-continued

| REFERENCE NUMERALS | |
|---|---|
| 44 | Section |
| 45 | Side circumference |
| 46 | Nozzle segment |
| 47 | Nozzle block |
| 48 | Layer thickness |

The invention claimed is:

1. A method of cold rolling of a metallic rolling stock (1), in particular of a rolling strip (1*b*), wherein:

the rolling stock (1) is displaced under a processing temperature through a roll gap (40) of a working roll pair (2, 3) to undergo a plastic deformation; and in a wedge region (18, 19) of the rolls-strip exit side, a deep chilled inert gas is applied to the surface of the rolling stock and is fed in the roll gap in form of jet groups for inerting and cooling;

characterized in that an inert gas is applied, alternatively or in addition to the surface of the rolling stock in a region of the strip exit (21, 22);

the strip exit side inert gas also provides for cleaning of the surface of the rolling stock;

a separate medium for lubrication in form of a jet group is applied to the surface of the rolling stock and/or fed in the roll gap in a region of the strip entry (7, 8) and/or roll gap entry side (11, 9), and is applied in a minimum amount with a layer thickness corresponding to surface roughness of the surface of the rolling stock.

2. A method according to claim 1, characterized in that the inert gas is applied to the surface of the rolling stock or is fed in the roll gap in a region of the strip entry (6, 7) and/or a region of the roll gap entry side.

3. A method according to claim 1, characterized in that media is applied to the upper and lower surface of the rolling stock and, in the rolling gap, to the upper surface and, in a rolling gap, to the lower surface.

4. A method according to claim 1, characterized in that lubricant jets are surrounded by inert gas having a matching temperature.

* * * * *